US005876068A

United States Patent [19]

Schneider et al.

[11] Patent Number: 5,876,068

[45] Date of Patent: Mar. 2, 1999

[54] SECURITY ELEMENT IN THE FORM OF A THREAD OR STRIP TO BE EMBEDDED IN SECURITY DOCUMENTS AND METHODS OF PRODUCING IT

[75] Inventors: Walter Schneider, Miesbach; Theo Burchard, Gmund, both of Germany

[73] Assignee: GAO Gessellschaft für Automation und Organisation GmbH, Germany

[21] Appl. No.: 645,823

[22] Filed: May 14, 1996

Related U.S. Application Data

[63] Continuation of Ser. No. 455,347, Feb. 14, 1990.

[30] Foreign Application Priority Data

Mar. 4, 1988 [DE] Germany ..... 38 07 126.6
Nov. 4, 1988 [WO] WIPO ..... PCT/EP88/01004

[51] Int. Cl.[6] ..... B42D 15/00

[52] U.S. Cl. ..... 283/86

[58] Field of Search ..... 283/83, 84, 89, 283/86, 94, 91, 113, 901

[56] References Cited

U.S. PATENT DOCUMENTS 5,388,862 2/1995 Edwards ..... 283/83 X
5,627,663 5/1997 Horan et al. ..... 283/86 X

*Primary Examiner*—Willmon Fridie, Jr.
*Attorney, Agent, or Firm*—Fulbright & jaworski LLP

[57] ABSTRACT

A security element in the form of a thread or strip to be embedded in security documents such as bank notes, checks, bonds, identity cards, credit cards or the like, having characters, patterns, etc., that are readable by transmitted light to the naked eye and/or by machine. The security element consists of a transparent plastic film having an opaque coating extending over the element with recesses in the form of the characters and patterns to be introduced. The security element also contains, in areas congruent with the recesses, coloring and/or luminescent substances which cause the characters and/or patterns to differ from the security document and from the opaque coating by color contrast under suitable light conditions.

13 Claims, 3 Drawing Sheets

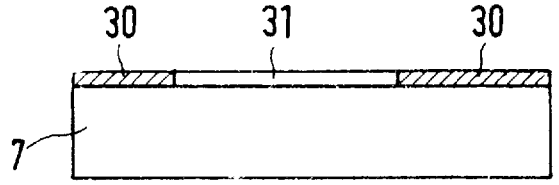
FIG. 6
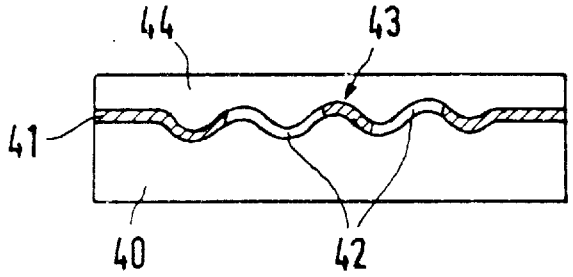
FIG. 7
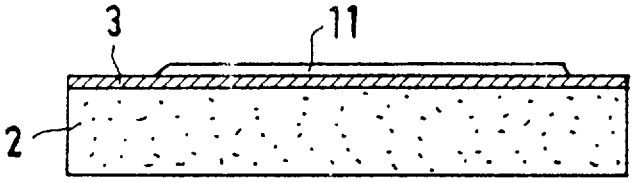
FIG. 8a
FIG. 8b
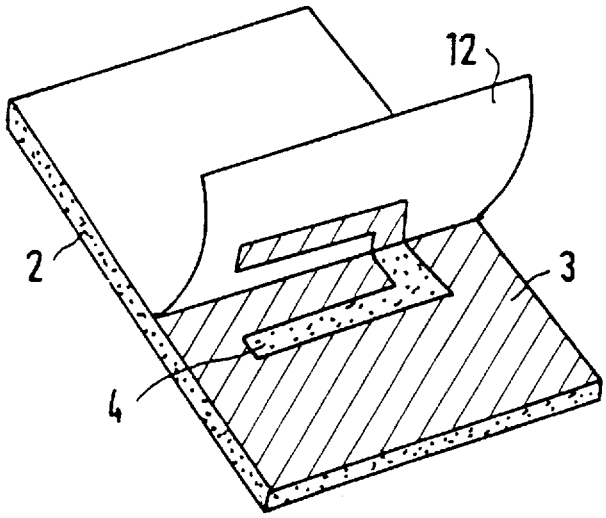
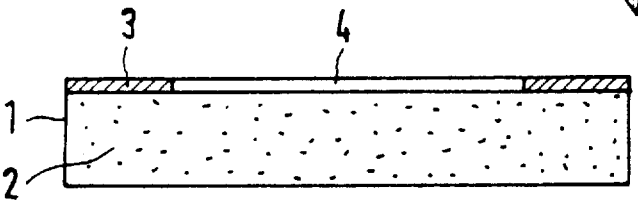
FIG. 8c

SECURITY ELEMENT IN THE FORM OF A THREAD OR STRIP TO BE EMBEDDED IN SECURITY DOCUMENTS AND METHODS OF PRODUCING IT

This is a continuation of application Ser. No. 07/455,347, filed Feb. 14, 1990.

BACKGROUND OF THE INVENTION

1. Field of the Invention

The present invention relates to a security element in the form of a tread or strip to be embedded in security documents such as bank notes, checks, bonds or the like, having characters, patterns, etc., that are readable by transmitted light to the naked eye and/or by machine, and to methods of producing such security documents.

2. Description of the Related Technology

It has been known for some time to protect bank notes and other money-value papers such as cheeks, shares, travelers checks, check cards and credit cards, but also passports and identity cards, by adding so-called security threads. Papers of this kind shall be referred to in the following as security papers. The security threads used for this purpose are made of a great variety of materials in the form of fine strips which are added in widths of 0.4 to 2 mm to the paper sheet during its manufacture. They are primarily produced from plastic films coated with metal foils, printed, colored or provided e.g. with pigmentlike substances. Furthermore, it is also known to give these security threads magnetic, fluorescent, X-ray absorbent and other properties by applying appropriate substances.

It has proven particularly advantageous to use security threads with microprints, whereby this microprint may contain information that is readable by the naked eye or else only by machine.

With respect to protection from forgery, security threads with metallically reflecting surfaces have proven particularly useful, since such threads introduced inside the paper are almost invisible by incident light, as the light rays passing through the upper layer of paper are completely reflected by the metallic surface and leave the paper diffusely scattered. By transmitted light, however, such threads appear as black strips which are clearly distinct from their surroundings. Threads of this kind cannot be imitated by printing on the paper. On the other hand, they show the disadvantage that a corresponding impression can be incorrectly aroused by introducing thin aluminum foils between two layers of paper. It has therefore been proposed to provide such aluminized security threads with microwriting (German laid open print no. 14 46 851). However, this has proven to be of little use in practice since this writing cannot be detected on the otherwise opaque security thread by transmitted light, and can only be detected with great difficulty by incident light. It is usually necessary to make the paper transparent with chemical means at least for the time of testing. The execution of such microwriting in special, e.g. fluorescent, colors has proven to be of little advantage in the same way and for the same reasons.

German "Auslegeschrift" no. 22 05 428 discloses a security thread designed as a metal strip and having a machine readable and/or visually readable coding applied by laser. The writing on this thread, that may possibly contain alphanumeric characters, consists of perforations, whereby the diameter of the holes or "line width" is to be small compared to the thickness of the metal strip in order to impede imitation.

Due to their extremely small line width, the characters of this security thread are detectable as poorly visible lighter areas on the dark background. Furthermore, such writing is relatively troublesome to produce, since very powerful lasers are required to provide the perforations in the metal thread. The perforation of the security thread material is so time-consuming that this method cannot be used for producing large amounts (thousands of kilometers) simply for reasons of time and thus of costs.

U.S. Pat. No. 4,652,015 also discloses a security thread to be used for bank notes and the like, on which metallically shining microcharacters are provided on clear transparent film material. The security thread and microcharacters located thereon as described in this patent are not detectable by incident light. However, by transmitted light solely the characters are detectable as sharp contours since the security thread itself is of transparent design. This security thread is produced by metalizing a transparent film over a large surface with a thin aluminum layer, printing the microcharacters on this layer using an acidproof ink and then etching away the unprinted areas, whereupon the characters are left on a transparent base.

By transmitted light an observer thus sees only writing that runs through the bank note. However, a disadvantage is that this writing is difficult to find due to the small size of the characters, its embedding in the paper pulp and a printed pattern that may be superimposed. The thread as such cannot be detected by the naked eye and cannot be felt as an uneven formation on the surface of the paper due to the extremely thin design required here. These detection features that normally characterize a security thread are thus no longer present in the known thread.

SUMMARY OF THE INVENTION

The invention is based on the problem of providing a security thread with characters and patterns that are readable to the naked eye and/or by machine, whereby both the thread structure and the characters and patterns are clearly recognizable when the thread is embedded in a document, and whose visual impression and protection from forgery are improved.

This problem is solved by the features stated in the characterizing part of the main claim. Developments of the invention and methods for producing such security elements are the subject of subclaims and independent claims.

In a preferred embodiment, the security thread consists of a transparent plastic film provided on one side with a metal coating. Characters are introduced into this reflecting metal coating, that is opaque by transmitted light, by locally removing the coating material. In addition to this metal coating, the thread is provided with a coat of color which may extend over the entire thread surface. The coloring agents used have no opaque effect and are preferably glazing printing inks in various colors and tones. However, the plastic film may also be colored with appropriate coloring agents in such a way that its transparency is retained in a partial region of the visible spectrum.

When such a thread is regarded by transmitted light after it is embedded in paper or only white translucent plastic material, as is sometimes used for producing identity cards or credit cards, the thread is detectable quite readily as a dark strip in the document and the characters and patterns are distinct as light, colored areas compared to their direct surroundings, the opaque thread coating, and additionally compared to the wider surroundings, the white paper or plastic material. The thread is thus very easy to find in the document, and the characters are clearly recognizable due to their contrasting effect with the surroundings and can be read at any time without aids if their size is appropriate.

While the characters thus appear by transmitted light as colored characters compared to the dark or white background, the thread is invisible or only barely visible by incident light due to the greatly reflecting metal coating and the use of glazing or nonopaque coloring agents. It can therefore not be imitated by an external print, which is inevitably clearly visible both by incident light and by transmitted light.

Suitable opaque coating materials are not only metal layers but also nonmetallic layers that contrast with their surroundings in terms of color and/or gray tones when viewed by transmitted light, such as opaque, preferably white, layers of color, metallically shining layers such as titanium nitride, interference layers such as those disclosed e.g. in U.S. Pat. No. 3,858,977.

By using luminescent colors, one can further improve the visual impression of this thread and make it more effective. The luminescent colors can either be colorless in the unexcited state or have a body color that preferably differs from the color of the emission light. The characters or patterns then appear in color or change their color only in the excitation light when the thread is regarded e.g. in UV light. Several luminescent substances emitting in different colors increase both the possibilities of design and the protection from forgery, since accurate imitation can only be performed by analyzing each individual luminescent substance. This analysis can easily be impaired further by printing the different luminescent colors in a mixed or overlapping fashion.

Diffraction grids or holograms can also be used to obtain a great variety of color effects. The diffraction structures are present e.g. in the form of volume or embossed holograms directly as embossing in the carrier material of the plastic thread or in an additional layer.

The reflecting metal layer existing in the case of reflection holograms or grids is interrupted here preferably by one of the methods stated below, to produce writing or a pattern visible by transmitted light.

Such a thread is preferably embedded in the document in such a way that it is directly visible or appears on the surface at least in some places. Methods for embedding it in the paper of value so as to form a window in the security thread area are known e.g. from German laid open print no. 36 01 114. With a thread embedded in this way, primarily the hologram diffraction grid or reflection pattern is thus visible in the reflection in the window area, while the negative writing or pattern worked into the metal coating dominates when viewed by transmitted light.

To produce such security threads, one first vaporizes a thin aluminum layer over the entire surface of e.g. colored, printed and/or luminescent plastic films that are transparent in a partial region of the visible spectrum. The recesses are then applied in this metal layer in the form of the desired characters and patterns by known methods (etching, spark erosion, etc.). The thread thus produced then shows the desired properties. If spark erosion (also known as electroerosion) is used, it is advantageous if the electrodes already have the form of the characters and patterns to be provided. In this way one can obtain extremely fine microcharacters of good quality.

According to a preferred production method, one resorts to the means basically known from printing technology for producing the characters and patterns, printing them on the metalized side of the film by known microprinting methods. However, one uses a printing ink that has e.g. thermoplastic properties, i.e. becomes soft and sticky at higher temperatures. If a film pretreated in this way is laminated by means of heat and pressure against a second untreated sheet of film, the two films adhere to each other in the area of the printed characters or patterns. When the cooled films are later separated, the areas corresponding to the characters or patterns are taken out of the aluminum coating. One thus obtains a metalized film material having characters or patterns in the form of transparent colored dots or lines in the otherwise opaque reflecting surface.

It is advantageous if the film for producing the security thread is first provided with a priming in the form of printing ink before the above-described method is carried out, and this prime coat is then metalized. In this case, one can apply the prime coat in the form of a colored and/or luminescent surface instead of using colored films.

In a further embodiment, this colored prime coat can also be executed in the form of a multicolored printed pattern, resulting e.g. in a random distribution of the coloring in the various characters. One can thus produce threads having microwriting that shimmers in many colors and appears light on a black background.

In a further embodiment, the film material can first be provided with the colorless prime coat, while the colored transparent layer of ink is applied to the opposite side of the film. This method offers advantages if different qualities of ink must be used for the prime coat and colored transparent layers. After subsequently metalizing the prime coat, one can proceed in the above-mentioned way.

The hot embossing method known as such can also be used advantageously for selectively metalizing colored or printed security threads. This method can be used advantageously in particular in connection with "light collecting films" as the film material. These films have the property of "collecting" incident light and making it emerge in a certain color and only in edge areas or at irregularities in the surface. Since the hot embossing method involves embossing the characters or patterns into the film and these embossed structures constitute such irregularities, the characters appear with a luminous contour. On light collecting films having daylight fluorescent properties, such colored luminous effects are also visible in daylight.

According to a further method, a pattern is first printed on the film as it should later appear as a negative image in the metal coating, and the opaque coating, e.g. the metal coating, applied in a second method step. To apply the printed pattern one uses printing inks or varnishes that show poor adhesion on the film and/or on metal coatings, so that the metal coating either alone or together with the printing ink can be removed solely in mechanical fashion by an air or liquid jet. This method is used for making packaging materials and is basically known from German laid open print no. 36 10 379. Instead of a liquid jet, one can also use mechanical scraping means to remove the poorly adhesive ink. It is more advantageous than the above method, however, to use printing inks which can thereafter be dissolved chemically under the metal coating. But it has turned out that the ink is generally not solubilized sufficiently for completely removing the metal layer in the entire printed area. However, if an ultrasonic source is provided in the solution bath or the film is drawn through an ultrasonic bath after the solution bath, the printed film is completely removed in a simple way in one operation.

According to a further method variant, one uses printing inks that become brittle when drying. If the films printed therewith and then metalized are drawn through an ultrasonic bath, these inks are removed without a chemical solution process solely by the effect of the ultrasonic field, thereby producing the desired negative writing in the metal coating. Suitable inks are e.g. inks based on a novolak medium. The ultrasonic bath is in this case a liquid container with an ultrasonic generator disposed therein or thereon, whereby the liquid plays the part of the coupling medium and water can be used in the most simple case.

Further advantages, advantageous developments and methods for producing inventive security threads are the subject of the description of the invention with reference to figures. To make the actual state of affairs clearer, the figures are not true to scale or proportion.

BRIEF DESCRIPTION OF THE DRAWINGS

FIGS. 3 to 7 show various embodiments of an inventive security thread, FIGS. 8 to 10 show various methods for producing such security threads, at the various stages.

DESCRIPTION OF THE PREFERRED EMBODIMENTS OF THE INVENTION

Figure 1:
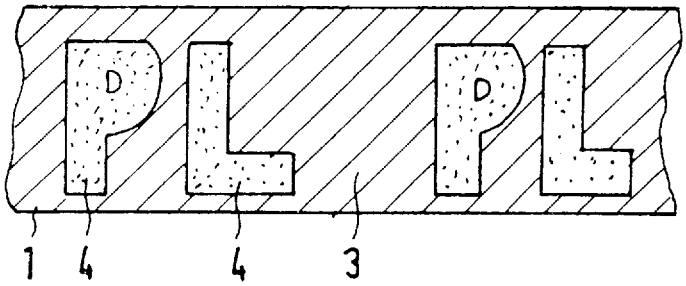
FIG. 1 shows an inventive security thread in a plan view.

FIG. 1 shows a security thread 1, consisting of a plastic strip 2 (FIG. 2) made of a plastic material resistant to tearing, such as polyester, one surface of which is provided with an opaque coating 3. The coating is preferably a reflecting metal layer, e.g. an aluminum layer, or a white coat of color appearing opaque by transmitted light, that has recesses 4 in the form of the characters and patterns to be applied to the security thread. In both cases this coating is invisible by incident light after the thread is embedded in security paper 5 (FIG. 2) since the light reflected by the metal surface is scattered diffusely in the paper, or the white layer of color is not distinct from the white paper pulp. The recesses in this opaque coating are thus only detectable as light areas when regarded by transmitted light.

Figure 2:
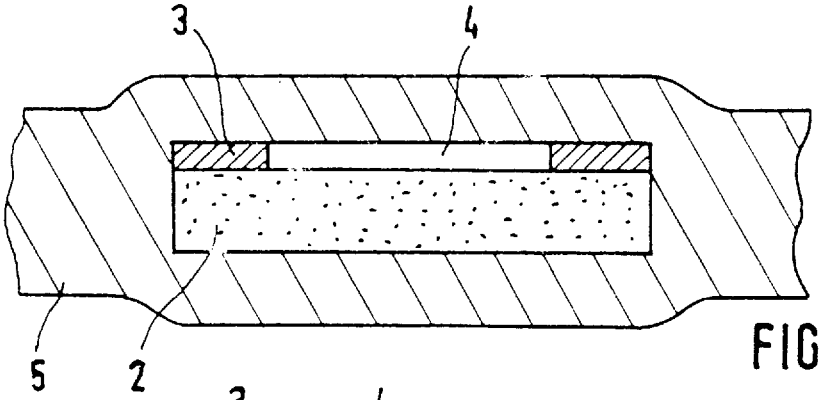
FIG. 2 shows the security thread in a sectional view after being embedded in a paper carrier.

In the example shown in FIGS. 1 and 2, plastic film 2 is colored with preferably organic coloring agents which reduce the transparency of the film in a partial region of the visible spectrum. Films with similar properties are used e.g. in optics as filters. Depending on the coloring of the film, the characters appear in a specific color when regarded by transmitted light and are thus not only distinct from the opaque coating appearing black, but also in color contrast with the layer of paper that is usually white.

The coloring agents may be supplemented or replaced by luminescent substances, so that the characters only show color or appear in a different color when excited appropriately. If the luminescence is strong enough, the thread is also visible by incident light. If it is regarded from the metalized side the characters are detectable, while from the opposite side, with the source of excitation light on the observer's side, the thread is visible as a homogeneous fluorescent strip. This property can be used selectively as a further characteristic of authenticity.

Figure 3:
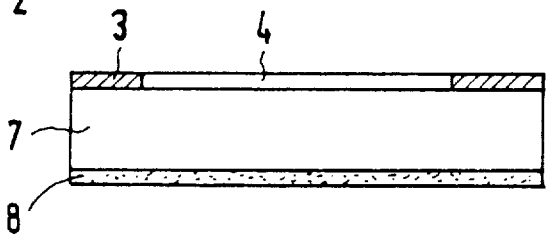
Figure 4:
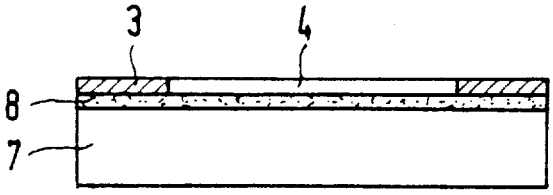

The coloring of the plastic film shown in FIG. 2 can be replaced by providing a layer of color 8 on a completely transparent film, applying it e.g. to the surface opposite metal coating 3 (FIG. 3) or introducing it as a prime coat between the metal layer and the film (FIG. 4). The separate application of this layer of color 8 makes it possible to apply a multicolored print here in any desired pattern, making the characters also appear in different colors and patterns. The films used may then be commercially available transparent films. The printed patterns can be adapted to the particular application. For example. for security threads to be embedded in bank note paper, one can select the colors in accordance with the particular national colors.

Figure 5:
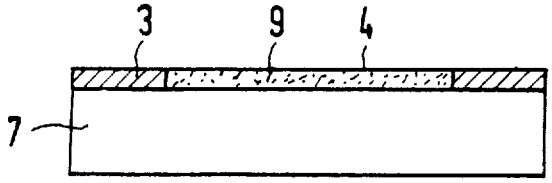

FIG. 5 shows a further embodiment in which coloring agents and/or luminescent substances 9 are only present in the area of recesses 4 in metal coating 3. Suitable coloring agents are e.g. glazing printing inks which have been printed into the recesses in an opaque white layer of color or a metal coating.

FIG. 6 shows a security thread comprising a transparent plastic film 7 and a cover layer 30 in the form of an optical interference filter as known e.g. from U.S. Pat. No. 3,858,977. This cover layer has local interruptions 31 for representing a pattern, characters, numbers, etc. This interference filter has the property of changing color when the manner of viewing changes from reflections to transmission.

If these threads are worked into the paper of value, the thread preferably being embedded in such a way that it appears at least partly on the surface, the pattern or writing is visible against a differently colored background depending on whether it is viewed by incident or by transmitted light. If film 7 has a third color or an additional layer of color is applied, an iridescent effect results from these colors and the mixed colors.

However, the security thread can also be equipped additionally with optically varying structures such as holograms, diffraction grids or threedimensional reflecting structures, whereby the negative writing visible at least by transmitted light is provided e.g. in the reflecting metal layer already existing in the case of reflection holograms or in the opaque coating or layer existing in the case of volume holograms.

FIG. 7 shows a simple embodiment of such a security thread. The carrier material is a tear-resistant embossable plastic film 40, whereby composite films can also be used to obtain these two properties. This film is provided with a reflecting opaque metallic coating 41 to which negative writing or a negative pattern is applied preferably by one of the methods stated below. Optically effective structures 43, such as holograms, diffraction structures or reflection patterns, are then embossed in the metalized surface in the form of surfaces, etc., inclined at different angles to the document plane. An additional transparent protective layer 44 protects these structures and the metal coating from external mechanical and chemical influences.

So that the optically effective structures are readily visible at least locally even if the security thread is embedded in paper, the thread is embedded in such a way that it passes to the surface of the paper at least in part. Methods of doing this are already known e.g. from the publications stated at the outset. If necessary, the other embodiments of security threads described above can also be embedded in the document paper by one of these methods in the form of so-called window security threads.

Methods for producing security threads with negative writing or patterns in an opaque coating shall be described in more detail in the following.

According to a preferred method, an e.g. colored transparent film is first printed with the characters and the film then metalized across the full surface over the characters. If the ink is selected in such a way that the adhesive effect between the ink and the plastic film is smaller than the adhesive effect between the metalizing and the film, the metal coating can be removed in the printed areas with the aid of an adhesive tape with suitable adhesive strength. Here is an example.

EXAMPLE 1

A polyester film with a thickness of 23 micrometers (e.g. Melinex from the ICI company) is printed with characters by intaglio printing using the gravure ink described below. The printed film is then aluminized over the printing in a thickness of 1 micrometer. Finally, the metalized film is pressed against a commercial adhesive tape, whereby the places corresponding to the characters are torn out of the metalizing at the previously printed places due to the poor adhesion of the aluminum layer there. This gives rise to writing or characters that appear colored and transparent on the otherwise opaque aluminum layer. The ink meets the following formulation:

100 g of ethyl alcohol 20 g of Movital B20H (Hoechst company)

0.3 g of an alcohol soluble coloring agent (e.g. Neozapon blue from the BASF company)

According to a further method (FIG. 8), plastic polyester film 2 serving as a carrier film, that is e.g. colored and transparent, is first provided with a metal coating 3, e.g. aluminum, by conventional methods over the entire surface on at least one side. The desired characters and patterns are printed on this coating, using as ink 11 a thermoplastic synthetic color which shows an adhesive effect in the softened state and connects intimately with the metal coating (FIG. 8*a*). After cooling, i.e. rehardening, of the thermoplastic ink, the adhesive effect should be greater between the ink and the metal coating than between the metal coating and the carrier film. If film 2 pretreated in this way is laminated by means of heat and pressure onto film 12 to which thermoplastic ink 11 also adheres well, and these two films are separated after cooling, metal coating 3 is locally removed along with ink 11 (FIG. 8*b*). Metal coating 3 remaining on security thread 1 than shows recesses 4 corresponding to the characters and patterns (FIG. 8*c*).

Suitable inks and method parameters to be observed can be derived from the following description of specific examples.

EXAMPLE 2

A polyester film with a thickness of 23 micrometers (e.g. Hostaphan from the Hoechst company) is coated over the entire surface with the formulation stated in Example 4. An aluminum layer with a thickness of 1 micrometer is then sputtered onto this formulation. Finally, characters or symbols are printed on the metalized layer with the aid of an intaglio cylinder, using the heat-set adhesive ink stated below.

100 g of distilled water 60 g of Vinnol dispersion 50/25 C (Wacker company)

1 g of Tylose MH 16000K (Hoechst company)

After printing, one can either roll up the material for later processing or immediately perform the next step without rolling it up. This subsequent working step involves pressing the printed film against an otherwise untreated Hostaphan film of the same kind and heating the pressing rollers to a temperature of 160° C. This causes the characters applied with heatset adhesive varnish to soften. The laminated film combination is then directed over a cooling roller and the two films then separated and rolled up separately. During the hot pressing operation the aluminized layer adheres to the additional polyester film through the intermediary of the heat-set adhesive characters. Upon subsequent cooling and separation the places in the aluminum coating corresponding to the characters are therefore torn out, making the desired writing or characters appear transparent in the otherwise opaque aluminum layer.

One can color the characters using an appropriately colored plastic film or provide the film with a single- or multicolored layer of color possibly having luminescent properties before or after applying the characters.

EXAMPLE 3

A polyester film (e.g. Melinex from the ICI company) is first sputtered with a layer of metallic nickel in a thickness of about 1 micrometer. The metalized film is then printed on the opposite side with a four-colored pattern using customary gravure inks. In the same printing operation or in a subsequent second printing operation, the metalized side is finally printed with colorless characters using the aforesaid heat-set adhesive ink. The film thus printed is hot pressed with the metalized side against a second polyester film, then cooled and the two films separated. The metallic nickel is thereby torn out in the places printed with the heat-set adhesive ink, so that the characters printed in this ink appear as light transparent places in the otherwise opaque thread. At theses places one can then see the four-colored printing applied to the back, so that by transmitted light one sees a multicolored pattern which is virtually invisible by incident light on the metalized side and can be poorly seen as a colored strip on the opposite side.

EXAMPLE 4

A polyester film with a thickness of 23 micrometers (e.g. Hostaphan from the Hoechst company) is sputtered on one side with one micrometer of aluminum. The opposite side of the film is printed by the intaglio method over the entire surface with an ink that is colorless in daylight but shows bright blue in UV light. The metalized side of the film is then printed with a heat-set adhesive color as in the previous example. The subsequent hot pressing, cooling and separation of the films again give rise to transparent characters in an otherwise opaque sheet which are detectable by transmitted light as light colorless characters or patterns. If such a material is embedded e.g. in bank note paper, it can virtually not be seen by incident light from either side of the paper. By transmitted light, a dark strip appears whose characters appear light. If ultraviolet light is additionally used, the introduced material appears in luminous bright blue on one side, while by transmitted UV light luminous blue characters appear on the other side.

A further method which allows in a most simple way for production of writing that appears light on surrounding material that is otherwise barely transparent and therefore appears dark consists in first printing the desired characters on a carrier material, e.g. a polyester film of commercial quality, and then metalizing the material. The film thus produced is thereafter directed through a solvent which can dissolve the printing ink. Suitable solvents can pass through the metal layer without corresponding difficulties and penetrate into the layer of ink therebelow. This causes the ink to swell and then become soluble under the metalized layer. However, the action of the solvent alone generally fails to bring about the desired success. It has now been found that the solvent action is effectively supported if an ultrasonic field is simultaneously radiated into the solvent bath, said field acting directly on the ink "acoustomechanically" and also bringing about a thorough mixture and swirling of the bath.

With the contributory action of this ultrasonic field, the layer of ink can be completely detached together with the metalization thereabove. This method is also suitable for locally removing other coatings. For example, coatings soluble in acids or alkalis, such as the acid-resistant metallically shining titanium nitride TINX, can therefore also be used for producing characters in an opaque coating.

This method, as well as those stated above, also offer the advantage that printing ink need only be used for the actual characters appearing light in the printing and the ink can be removed virtually in one operation by applying the solvent and ultrasonic energy simultaneously or directly one after the other. This minimizes chemical pollution of the environment. The substances contained in the ink can be separated by precipitation or concentration and reused, if desired. The solvents are of course reusable after metalization and do not pollute the environment either. The amounts of substance arising from the applied metal layer are small and can also be eliminated in a simple way by filtering.

A further advantage is that fine writing with very well defined edges can be obtained, while the rest of the surface remains completely intact. The materials produced in this way therefore have a particularly well defined and faultless appearance, which is especially advantageous when they are used as security elements with microwriting.

The printing inks used for producing the characters can be of extremely simple formulation. Inks of this kind need not by any means have any special properties such as durability, compatibility or resistance to acids or alkalis, since they are only required temporarily during the production process and they are intended only to dissolve in the solvent. It is thus sufficient to use an inexpensive, customary medium for printing inks.

EXAMPLE 5

An 8% solution is produced from a 30A type nitrocellulose and ethyl alcohol. This solution is colored as desired using any coloring agent, e.g. neozapon blue.

Using the above ink, any desired writing is printed on an RGH 23 type polyester film (made by Hoechst) by the intaglio method. The film thus printed is thereafter sputtered on the printed side with aluminum in a thickness of $0.2\mu$. Ethyl alcohol is then introduced into an ultrasonic bath and the ultrasonic generator switched on. The printed and metalized film is dipped for one second into the ethyl alcohol and then taken out and dried. The result is that the printing ink along with the aluminum thereabove is removed at the printed places and only at these places. The film shows the writing in the form of clear transparent places in an otherwise opaque surface.

Figure 9A:
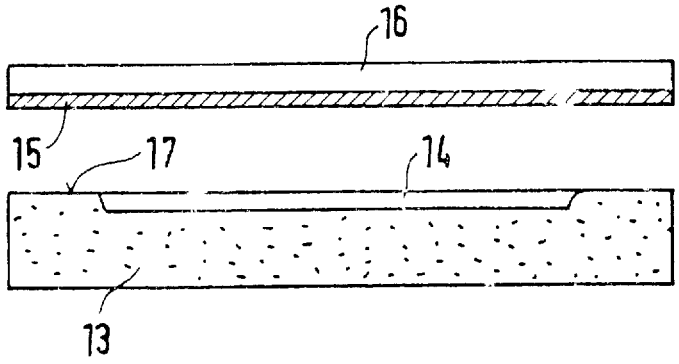
Figure 9B:
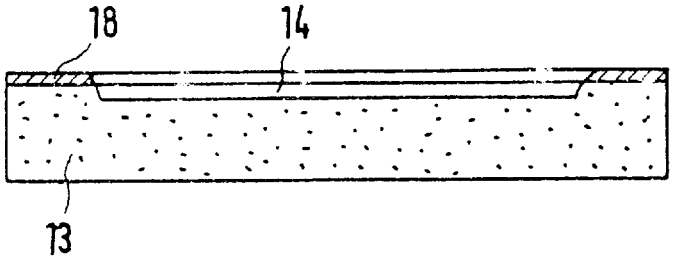

The hot embossing method known as such can also be used to produce the inventive security threads (see Kunststoffe 72 (1982), 11 "Heissprägen, ein modernes Verfahren für das Dekorieren von Kunststoffteilen" by H. Schütt and B. Seeberger, Fürth, pp. 701 to 707). Using the rolling method, one first embosses the characters and patterns into plastic film 13 (FIG. 9), so that they are present in the film surface as depressed areas 17. One then transfers metal coating 15 of a transfer band 16 to elevated areas 17 of the plastic film surface with the aid of a heated silicon embossing roller (not shown) (FIG. 9*a*). Lower areas 14 which represent the characters are not covered by a coating 18 (FIG. 9*b*). As shown in the above examples, plastic film 13 can again be colored or provided preferably on the back with appropriate printed patterns. The hot embossing method allows not only for the transfer of metallic layers of color but also for the use of sublimable colors which evaporate when being transferred and penetrate into the plastic film material. This considerably improves the adhesion.

In particular in connection with the hot embossing method one can also use "light collecting" films advantageously (Kunststoffe 75('85)5, "Kunststoffe, die Licht sammeln," pp.296 to 297, Dr. A. El Sayed). These light collecting films are films that usually contain luminescent substances activatable by daylight and make the "collected" light emerge only in the edge area or at irregularities in the surface. Such irregularities are e.g. the edge areas of the embossed characters. If such a light collecting film is thus used as the carrier film for the security thread and coated by the hot embossing method with an opaque layer of metal or color that does not cover the depressed character areas, these characters do not only appear as light characters compared to the opaque base but show bright color in the edge area. This luminous phenomenon can be varied in terms of its color, intensity and the necessary ambient light (daylight, UV) by appropriate selection of the light collecting film or the luminescent substances contained therein.

During production of the threads, in particular if one of the above methods is used, preferably wide sheets of film are first coated and written on in the desired security thread pattern. Only after these method steps are completed are the sheets of film then cut into individual threads. Methods for printing and cutting these films in exact register are known e.g. from EP-A 0 238 043.

Figure 10:
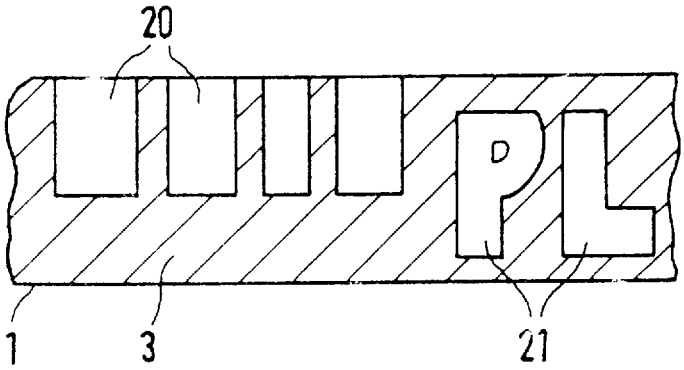

In security thread 1 shown in FIG. 10, opaque coating 3 is interrupted in the edge area in the form of a machine readable coding 20 e.g. in the form of a regularly recurring bar pattern. This coding can be applied in addition to or instead of humanly readable writing 21. The information provided by this coding may be e.g. the value of the bank note or a random piece of information for individualizing the thread. By linking this random information with other data specific to the document and/or the user, one can bind this thread unalterably to the particular document and/or user.

Security threads having machine readable coding in the edge area are basically known from German laid open print no. 28 08 552, although here the total thread is cut in the desired form along an edge. This cutting of the thread is rather troublesome and its embedding in the paper is also problematic since the thread can easily twist due to the constantly changing band width (garland effect) and very frequently tears under the unavoidable tensile stress exerted during incorporation of the thread in the paper pulp. Since one must separate out the portions of paper in which the thread does not lie flat or is not positioned correctly in the paper or the thread embedding is even interrupted, the incorporation of such threads involves a high reject rate. These disadvantages are eliminated by the inventive solution. The inventive thread has a constant width since only the thin opaque coating, and not the thread or plastic carrier, is of variable width. The coding, that can be printed onto a transparent plastic film by one of the above methods or else in a simple way, is perfectly readable by transmitted light due to the transparency of the film material and the opacity of the coating, in the same way as a cut thread.

If one uses carrier films that are colored or have a colored prime coat, the film area remaining transparent (not printed) is distinct in the form of a so-called negative coding pattern which extends parallel to the coding that appears opaque. If one uses colors that are only luminescent in UV light or with other special light sources, this color effect appears only in the special lighting, while in daylight the thread does not appear to the observer to differ from the known cut version.

If the opaque coating is printed on, it is again advisable to first print wider sheets of film and then cut the threads out of these printed sheets. Special random-controlled printing units can be used to introduce a random piece of information. However, such effects can also be obtained in a particularly simple way using e.g. two printing units which print on a pattern in an overlapping form with a different periodicity.

We claim:

1. A security element in the form of a thread or strip to be embedded in security documents, wherein the security element comprises a transparent plastic film having an opaque coating extending over the element with recesses corresponding to patterns to be introduced and, in areas congruent with the recesses, at least one of coloring substances and luminescent substances which cause the patterns to differ from the security element and from the opaque coating by color contrast under suitable light conditions.

2. The security element of claim 1, wherein the opaque coating is a metal coating.

3. The security element of claim 1, wherein the at least one of coloring substances and luminescent substances are contained in the plastic film.

4. The security element of claim 1, wherein the at least one of coloring substances and luminescent substances are printed on.

5. The security element of claim 4, wherein the at least one of coloring substances and luminescent substances are printed on the side of the film opposite the opaque coating.

6. The security element of claim 1, wherein the at least one of the coloring substances and luminescent substances are present in the form of at least one of a multicolored printed pattern and a luminescent pattern appearing in several colors.

7. The security element of claim 1, wherein the luminescent substances have an unexcited state and are colorless in the unexcited state.

8. The security element of claim 1, wherein the patterns are embossed into the film and are in the form of depressed areas.

9. The security element of claim 8, wherein the film has at least one of light collecting properties and luminescent properties in daylight.

10. The security element of claim 1, wherein the patterns are machine readable coding with at least one of the properties of extending in the longitudinal direction of the element and being located in the edge area of the element.

11. The security element of claim 10, wherein the machine readable coding is a random piece of information.

12. A security element according to claim 1, wherein at least some of the recesses are present in the edge area of the element and constitute a coding that is machine readable in transmission.

13. A security element according to claim 1, wherein said coating has dichroic properties and the security element shows a change of color when the manner of viewing changes from incident light to transmitted light.

* * * * *